US010867593B1

(12) United States Patent
Brimijoin, II et al.

(10) Patent No.: US 10,867,593 B1
(45) Date of Patent: Dec. 15, 2020

(54) IN-EAR EMITTER CONFIGURATION FOR AUDIO DELIVERY

(71) Applicant: Oculus VR, LLC, Menlo Park, CA (US)

(72) Inventors: William Owen Brimijoin, II, Kirkland, WA (US); Philip Robinson, Seattle, WA (US)

(73) Assignee: FACEBOOK TECHNOLOGIES, LLC, Menlo Park, CA (US)

( * ) Notice: Subject to any disclaimer, the term of this patent is extended or adjusted under 35 U.S.C. 154(b) by 0 days.

(21) Appl. No.: 15/969,533

(22) Filed: May 2, 2018

Related U.S. Application Data

(60) Provisional application No. 62/627,982, filed on Feb. 8, 2018.

(51) Int. Cl.
*G10K 11/178* (2006.01)

(52) U.S. Cl.
CPC .. *G10K 11/17823* (2018.01); *G10K 11/17853* (2018.01); *G10K 2210/1081* (2013.01); *G10K 2210/3028* (2013.01); *G10K 2210/3044* (2013.01)

(58) Field of Classification Search
CPC .... H04R 5/033; H04R 3/12; H04R 2205/022; H04R 2430/20; H04R 5/02; H04R 2430/23; H04R 25/405; H04R 1/1016; G10K 11/17823; G10K 11/17853; G10K 2210/1081; G10K 2210/3028; G10K 2210/3044
USPC ..... 381/71.6, 74, 313, 370, 376
See application file for complete search history.

(56) References Cited

U.S. PATENT DOCUMENTS 4,977,975 A * 12/1990 Lazzeroni ..... A42B 3/166 181/129
9,596,544 B1 * 3/2017 Brotherton ..... H04R 5/02
2004/0105550 A1 * 6/2004 Aylward ..... H04S 3/00 381/17
2007/0160243 A1 * 7/2007 Dijkstra ..... H04B 1/123 381/317
2010/0086166 A1 * 4/2010 Jiang ..... H04R 23/002 381/380
2012/0033826 A1 * 2/2012 Kakumoto ..... H04R 1/28 381/86
2013/0293723 A1 * 11/2013 Benson ..... G02B 27/017 348/164
2014/0193022 A1 * 7/2014 Koizumi ..... H04R 1/345 381/380
2014/0205131 A1 * 7/2014 Azmi ..... H04R 1/1075 381/380

* cited by examiner

*Primary Examiner* — Norman Yu
(74) *Attorney, Agent, or Firm* — Artegis Law Group, LLP

(57) ABSTRACT

One embodiment of the present applications sets forth a wearable device that includes an interface layer configured to extend into an ear canal and a first audio emitter configuration coupled to the interface layer. The first audio emitter configuration is configured to produce a first plurality of soundwaves that are each directed towards a first point proximate to the first audio emitter configuration. The first plurality of soundwaves generates a first target soundwave that radiates in a first direction.

20 Claims, 8 Drawing Sheets

IN-EAR EMITTER CONFIGURATION FOR AUDIO DELIVERY

CROSS REFERENCE TO RELATED APPLICATION

This application claims priority benefit of the United States Provisional Patent Application titled, "In-Ear Cylindrical Ring Array for Audio Delivery," filed on Feb. 8, 2018 and having Ser. No. 62/627,982. The subject matter of this related application is hereby incorporated herein by reference.

BACKGROUND

Field of the Various Embodiments

Embodiments of the present disclosure relate generally to audio processing and, more specifically, to an in-ear emitter configuration for audio delivery.

Description of the Related Art

Near-eye displays (NED) are used in conjunction with applications to add virtual elements to real environments and/or to simulate virtual environments. These applications may provide artificial reality content to a user, such as providing virtual reality (VR), augmented reality (AR), and/or mixed reality (MR) content. The artificial reality content may include audio content.

When providing audio content, a NED may deliver sound to the user via sound transducers. In some circumstances, however, the NED may allow sound created by the application to leak from the sound transducers into the surrounding environment. Such leaking of sound increases the likelihood of negatively disturbing the environment. In addition, the user no longer controls which sounds are heard by others in the environment.

SUMMARY

One embodiment of the present applications sets forth a wearable device that includes an interface layer configured to extend into an ear canal and a first audio emitter configuration coupled to the interface layer. The first audio emitter configuration is configured to produce a first plurality of soundwaves that are each directed towards a first point proximate to the first audio emitter configuration. The first plurality of soundwaves generates a first target soundwave that radiates in a first direction.

At least one advantage of the disclosed embodiments is that the audio emitter element provides a technological improvement of effectively directing created sound into the ear canal of the user without occluding other sounds.

BRIEF DESCRIPTION OF THE DRAWINGS

So that the manner in which the above recited features of the various embodiments can be understood in detail, a more particular description of the inventive concepts, briefly summarized above, may be had by reference to various embodiments, some of which are illustrated in the appended drawings. It is to be noted, however, that the appended drawings illustrate only typical embodiments of the inventive concepts and are therefore not to be considered limiting of scope in any way, and that there are other equally effective embodiments.

DETAILED DESCRIPTION

In the following description, numerous specific details are set forth to provide a more thorough understanding of the various embodiments. However, it will be apparent to one of skilled in the art that the disclosed concepts may be practiced without one or more of these specific details.

Embodiments of the disclosure may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) or near-eye display (NED) connected to a host computer system, a standalone HMD or NED, a mobile device or computing system, or any other hardware platform capable of providing artificial reality content to one or more viewers.

Figure 1A:
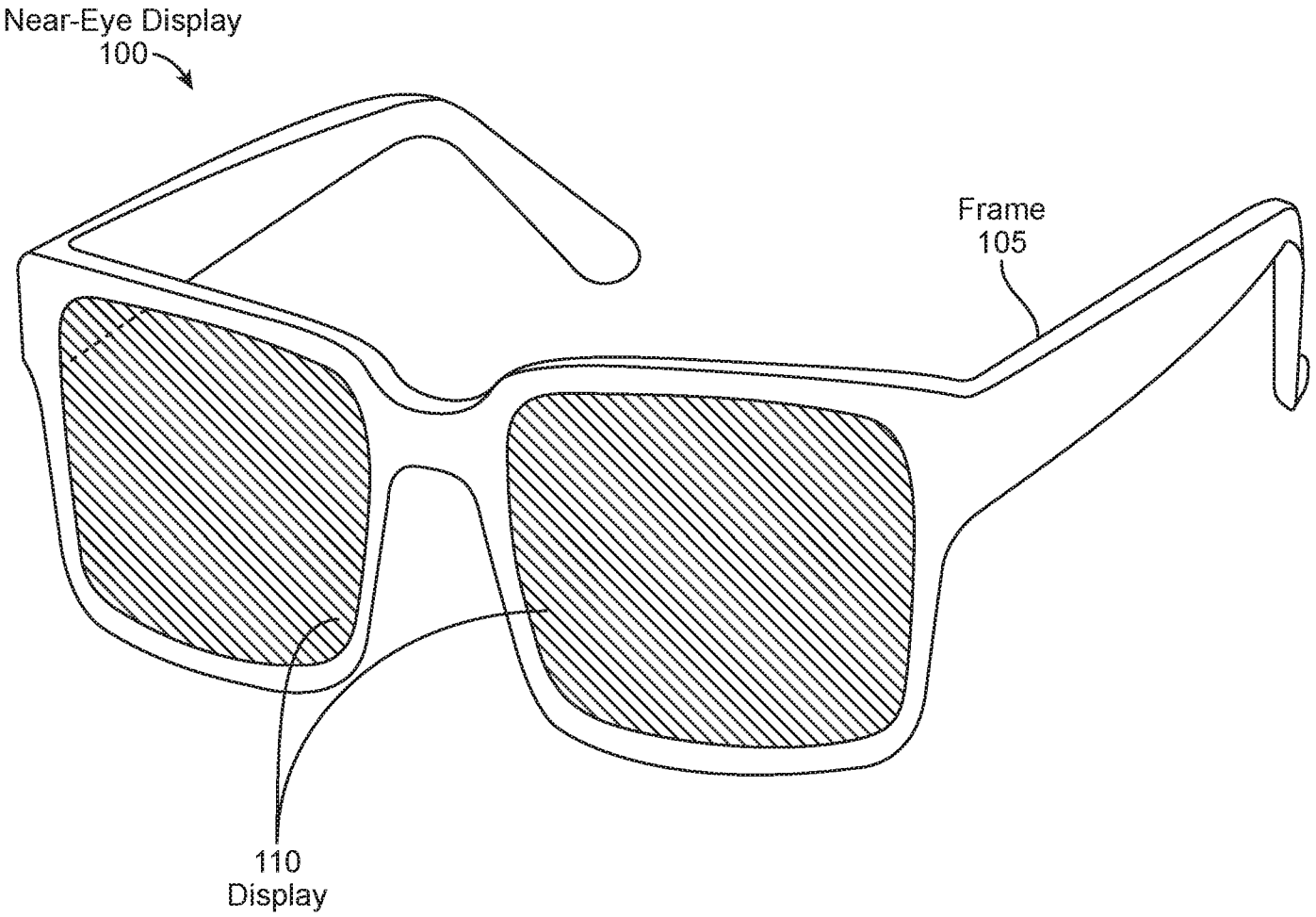
FIG. 1A illustrates a near-eye display (NED) configured to implement one or more aspects of the present disclosure.

FIG. 1A illustrates a near-eye display (NED) configured to implement one or more aspects of the present disclosure. In various embodiments, NED 100 presents media to a user. The media may include visual, auditory, and haptic content. In some embodiments, NED 100 provides artificial reality content by providing a real-world environment and/or computer-generated content. In some embodiments, the computer-generated content may include visual, auditory, and haptic information.

NED 100 includes emitter configuration 103, frame 105, and display 110. In various embodiments, the NED 100 may include one or more additional elements. Emitter configuration 103, and/or display 110 may be positioned at different locations on the NED 100 than the locations illustrated in FIG. 1. Emitter configuration 103 and/or display 110 are configured to provide content to the user, including audio-visual content. In some embodiments, one or more emitter configurations and/or one or more displays 110 may be located within frame 105.

Figure 1B:
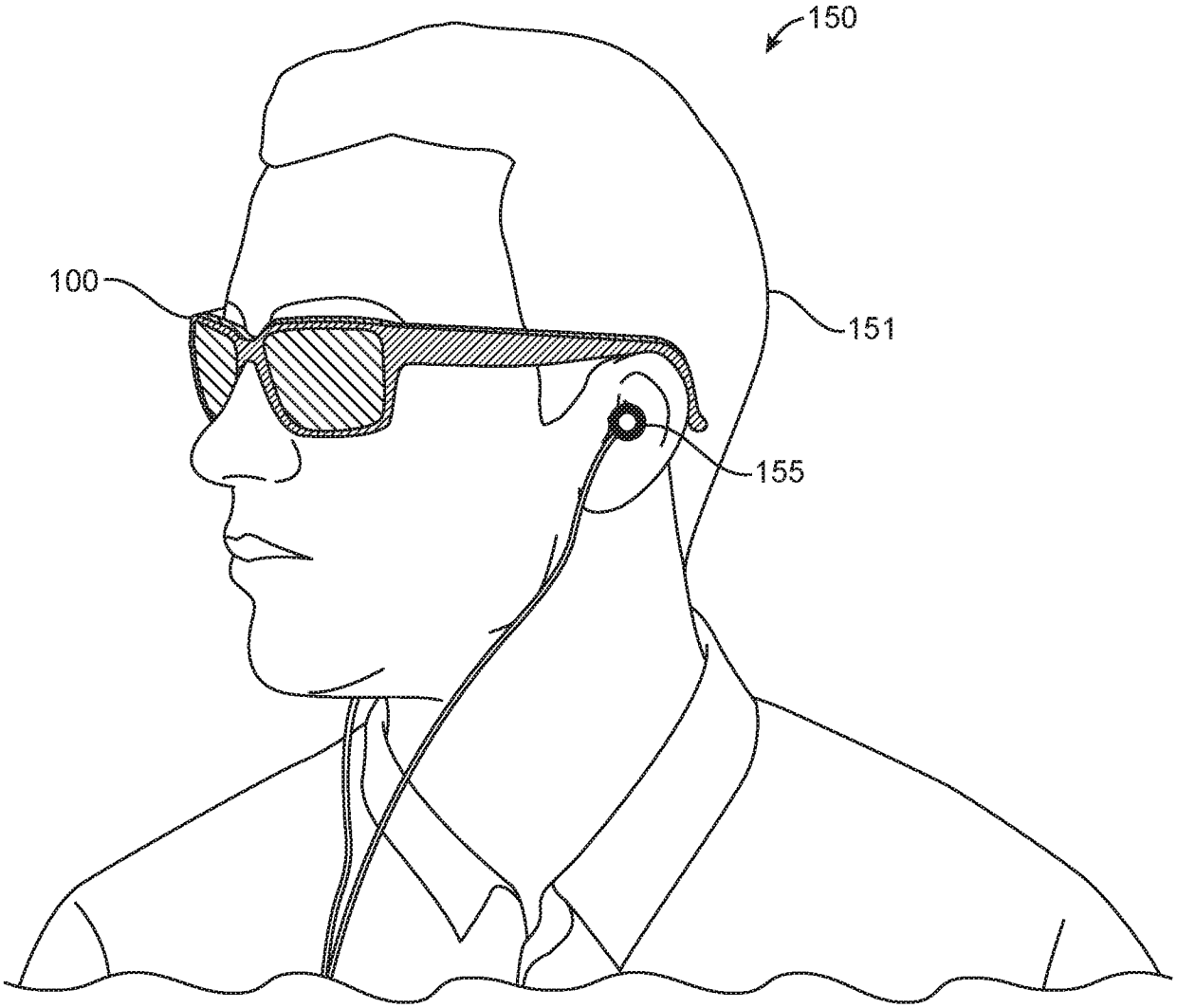
FIG. 1B illustrates a user interacting with the NED and an audio delivery system, according to various embodiments of the present disclosure.

FIG. 1B illustrates a user 151 interacting with NED 100 and audio delivery system 155, according to various embodiments of the present disclosure. In some embodiments, NED 100 may communicate with audio delivery system 155 to provide audio content to user 151. In some embodiments, audio delivery system 155 may provide audio content from an audio source without being coupled or communicating NED 100. In some embodiments, audio delivery system 155 is connected to NED 100 via one or more wires and one or more audio emitter devices included in audio delivery system 155 receive audio signals via the one or more wires. In some embodiments, one or more components of audio delivery system 155 communicate wirelessly with NED 100 or an audio source.

In some embodiments, audio delivery system 155 may be located within the ear of user 155 and produces sounds based on a received audio signal. In some embodiments, one or more audio emitter devices included in the audio delivery system are configured physically in the ear to allow additional sounds from the surrounding environment to travel through audio emitter device 155 to the ear of user 151. In such embodiments, audio delivery system 155 may include headphones and/or ear buds that are cylindrical shells that include a hollow interior. Sounds, e.g., sound from an external environment, may to travel through the hollow interior to the eardrum of the user.

Figure 2:
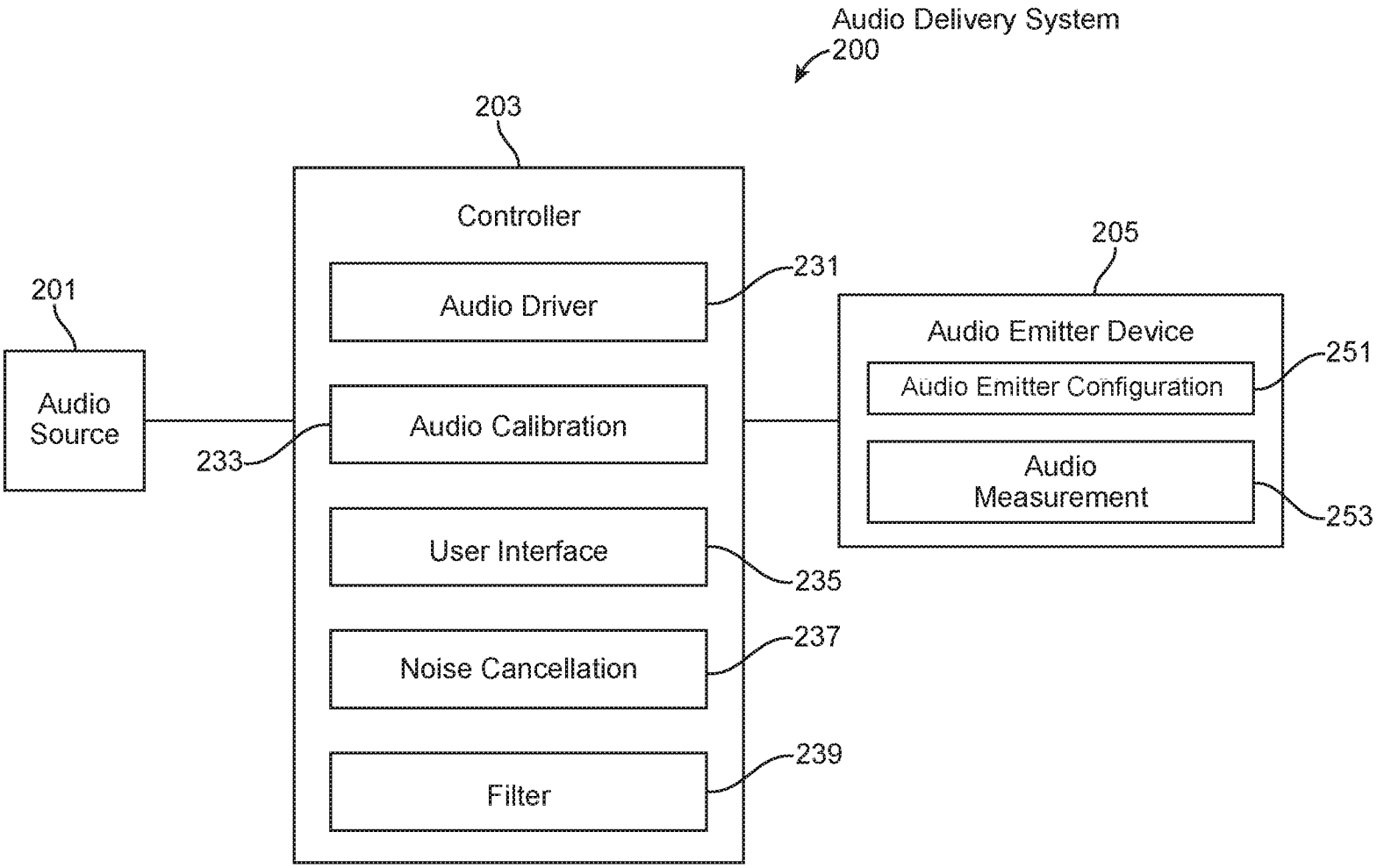
FIG. 2 illustrates the audio delivery system and the NED of FIG. 1B, according to various embodiments of the present disclosure.

FIG. 2 illustrates an audio delivery system 200, according to various embodiments of the present disclosure. Audio delivery system 200 includes an audio source 201, a controller 203, and an audio emitter device 205.

In some embodiments, one or more components of audio delivery system 200 may be included within or may be otherwise associated with NED 100. In some embodiments, one or more components of audio delivery system 200 may be included in a separate device that is coupled to NED 100 and/or communicates with NED 100. For example, one or more of audio source 201, controller 203, and/or audio emitter device 205 may be included in a device (not shown) that communicates with NED 100. In another example, audio emitter device 205 may be included in a separate device (not shown) comprising hardware and/or software that communicates with controller 203 within frame 105 of NED 100.

In various embodiments, audio delivery system 200 generates an audio signal for delivering audio to a user of system 200. Components of system 200 may be worn or otherwise attached to the user's body. For example, audio emitter device 205 may be physically placed at the concha and extending into the ear canal of the body. During operation, audio source 201 generates an audio signal. Controller 203 receives the audio signal from audio source 201 and generates one or more audio emitter driver signals. Audio emitter device 205 receives the audio emitter driver signals from controller 203 and causes one or more audio transducers included in audio emitter configuration(s) 251 to emit soundwaves. The configuration of audio emitter device 205 causes a soundwave that reproduces the audio signal to propagate in a specified direction. The soundwave causes the user of system 200 to hear audio content corresponding to the audio signal generated by audio source 201.

Audio source 201 generates one or more audio signals to be delivered to the user via audio emitter device 205. In some embodiments, audio source 201 generates an electrical signal that audio emitter device 205 reproduces as a soundwave. The soundwave generated by the audio emitter device 205 has on or more properties corresponding to the electrical signal. In some embodiments, an application may generate content for NED 100 by generating audio signals. When the application generates audio signals, the application may control the audio source 201 to output one or more specific audio signals to controller 203. In some embodiments, the application may control audio source 201 to output one or more audio signals in response to a user request.

Controller 203 includes audio driver 231, audio calibration module 233, user interface (UI) 235, noise cancellation module 237, and/or filter 239. Controller 203 receives the audio signal from audio source 201 and controls the soundwaves transmitted to the user via audio emitter device 205. In order to control the soundwaves transmitted to the user, controller 203 drives the audio emitter device 205 with an electrical signal ("audio emitter driver signal"). As discussed in greater detail below, in response to the audio emitter driver signal, audio emitter device 205 a soundwave.

In some embodiments, controller 203 may receive one or more audio signals transmitted by audio source 201. Controller 203 may respond to the audio signals received from audio source 201 by generating one or more audio emitter driver signals, where the one or more audio emitter driver signals are transmitted to audio emitter device 205. In some embodiments, controller 203 may generate separate audio emitter driver signals for each audio emitter configuration 251 included in audio emitter device 205. Further, in some embodiments, controller 203 may generate separate audio emitter driver signals for each audio emitter included in an audio emitter configuration 251.

In some embodiments, controller 203 may calibrate the characteristics of the one or more audio emitter driver signals transmitted to audio emitter device 205 based on the specific configuration of the one or more audio emitter configurations 251 and/or the structure and composition of one or more audio emitters included in the respective audio emitter configurations 251. As discussed in further detail below, controller 203 may implement one or more calibration modules, including audio calibration module 233, noise cancellation module 237, and/or filter 239 to adjust one or more characteristics of the audio emitter driver signal. For example, audio driver 231 may receive a noise cancellation signal from noise cancellation module 237 and adjust the characteristics of the audio emitter driver signal such that the audio emitter driver signal compensates for the detected noise.

Audio driver 231 is hardware and/or software included within controller 203 that generates the one or more audio emitter driver signals. In operation, audio driver 231 receives an audio signal from audio source 201 and generates audio emitter driver signals that cause audio transducers, e.g., sound actuators, included in audio emitter configurations 251 to emit one or more soundwaves that reproduce the audio signal. As discussed in further detail below, multiple audio emitters may produce separate and distinct soundwaves that combine to produce a composite soundwave, where the composite soundwave reproduces the audio signal. In some embodiments, audio driver 231 may generate an audio emitter driver signal that causes audio emitter device 205 to produce a composite soundwave that propagates in a specified direction (represented as an angle diverging from a center axis) and at a specified amplitude.

In some embodiments, audio driver 231 may generate separate audio emitter driver signals for each audio emitter configuration 251. The separate audio emitter driver signals incorporate a delay between each audio emitter configuration 251. In some embodiments, audio driver 231 may generate separate audio emitter driver signals for each audio emitter in an audio emitter configuration 251 based on the configuration of audio emitter device 205. For example, audio driver 231 may cause multiple audio emitter configurations 251 to reproduce the audio signal with an incorporated delay between the individual audio emitter configurations 251. In various embodiments, the delay enables audio emitter device 205 to generate a composite soundwave that propagates in a specified direction within audio emitter device 205.

Audio calibration module 233 is hardware and/or software included within controller 203 that generates one or more calibration parameters. The calibration parameters may be based on measurements received from audio measurement module 253 included in audio emitter device 205. In some embodiments, controller 203 may adjust one or more audio emitter driver signals generated by audio driver 231 based on the calibration parameters generated by audio calibration module 233. In some embodiments, audio calibration module 233 may generate calibration parameters for audio driver 231. In such embodiments, audio driver 231 may generate one or more audio emitter driver signals that modify the audio signal received from audio source 201 based on the calibration parameters.

For example, when controller 203 generates multiple audio emitter driver signals that incorporate a target time delay between individual audio emitter configurations 251, audio calibration module 233 may receive measurements from audio measurement module 253 relating to the delay between audio emitter configurations 251. Audio calibration module 233 may generate calibration parameters to maintain the target time delay. Audio driver 231 may also generate audio emitter driver signals with characteristics that incorporate the calibration parameters to maintain the target time delay between audio emitter configurations 251. In another example, when audio measurement module 253 is a thermometer, audio calibration module 233 may receive temperature measurements and, based on a computation of the speed that soundwaves travel within audio emitter device 205, generate calibration parameters for audio emitter device 205. The calibration parameters may modify audio emitter device 205 such that time delays between audio emitter configurations 251 cause a composite soundwave generated by audio emitter device 205 to propagate in an intended direction.

User interface (UI) 235 is hardware and/or software included within controller 203 that enables a user to interact with one or more components of audio delivery system 200. In some embodiments, a user transmits an action request to an application via UI 235 to perform a particular action. In some embodiments, the user makes the action request using one or more input devices, such as a keyboard, mouse, controller, and/or any other suitable devices that enable a user to transmit the action request to controller 203. In some embodiments, controller 203 may interact with an application and/or audio source 201 to modify the audio emitter driver signal based on interactions received from the user via UI 235.

Noise cancellation module 237 is hardware and/or software included within controller 203 that generates a noise cancellation signal. In some embodiments, noise cancellation module 237 may receive one or more measured audio signals from audio emitter device 205 and/or one or more measurement values from audio measurement device 253. In some embodiments, noise cancellation module 237 receives a measured audio signal from audio emitter device 205. In some embodiments, the measured audio signal may be a portion of an audio signal recorded by audio measurement device 253. In some embodiments, noise cancellation module 237 provides active noise control by generating a noise cancellation signal based on noise detected from the measured audio signal and/or measurement values. In such instances, noise cancellation module 237 may determine a noise component from the measured audio signal and/or measurement values and may generate the noise cancellation signal. In some embodiments, controller 203 may cause audio driver to incorporate the noise cancellation signal into the characteristics of the generated audio emitter driver signal. Audio emitter device 205 may emit a soundwave, where the soundwave includes an anti-noise portion that provides destructive interference with the detected noise. For example, when audio measurement module 253 is a microphone included in audio emitter device 205, noise cancellation module 237 may receive a measured audio signal from the microphone, where the measured audio signal includes a noise component. Noise cancellation module 237 may then generate a noise cancellation signal that causes audio emitter device 205 to emit a soundwave that includes an anti-noise component that has the same amplitude and is antiphase to the noise component.

Filter 239 is hardware and/or software included within controller 203 that compensates for unwanted environmental filtering of the composite soundwave produced by audio emitter device 205. In some embodiments, filter 239 may be a component that receives a measured audio signal and/or measurement values from audio measurement module 253 and generates a compensation signal for controller 203. Controller 203 may cause audio driver 231 to generate one or more audio emitter signals that have characteristics that incorporate the compensation signal. Audio emitter device 205 may produce the composite soundwave while compensating for unwanted filtering of the composite soundwave based on the composition or other characteristics of audio emitter device 205. In some embodiments, controller 203 and/or filter 239 may model the unwanted filtering as a transfer function and modify the filter 239 to be implemented as an inverse filter of the modelled transfer function. In various embodiments, when an input signal passes through the series of filters, the resulting output signal is equal (or substantially equal) to the input signal.

In some embodiments, controller 203 may implement audio driver 231 to generate one or more audio emitter driver signals based on calibration information received from one or more of audio calibration module 233, noise cancellation module 237, and/or filter 239. In some embodiments, audio driver 231 generates one or more audio emitter driver signals to compensate for deviations to audio emitter device 205 and/or changes to the configuration of one or more audio emitters included in audio emitter device 205 associated with the calibration information. In various embodiments, controller 203 may first calibrate audio emitter device 205 and then produce the one or more audio emitter driver signals. In some embodiments, controller 203 may receive feedback information during operation, such as a measured audio signal at audio emitter device 205 and/or measurement values from audio measurement modules 253. Controller 203 may configure audio calibration module 233, noise cancellation module 237, and/or filter 239 to modify respective calibration signals, noise cancellation signals, and/or compensation signals based on the measured audio signal and/or measurement values and modify the audio emitter driver signals based on the updated calibration signals.

Audio emitter device 205 includes audio emitter configuration(s) 251 and/or audio measurement module 253. In some embodiments, audio emitter device 205 is coupled to NED 100 and/or communicates with NED 100. In some embodiments, audio emitter device 205 is housed within frame 105 of NED 100. Audio emitter device 205 is configured to produce a composite soundwave that radiates towards a user's ear canal such that the user can hear audio content associated with an audio signal provided by audio source 201. In some embodiments, audio emitter device 205 may include a single audio emitter configuration 251 that produces a composite soundwave. In some embodiments, audio emitter device 205 may include an array of multiple audio emitter configurations 251 arranged in one or more configurations to produce the composite soundwave towards the ear canal.

In some embodiments, a single audio emitter configuration 251 may include one or more audio transducers that emit a soundwave with wave characteristics reproducing the wave characteristics of an input audio emitter driver signal. Audio emitters included in an audio emitter configuration 251 emit multiple soundwaves that combine to generate a composite soundwave that is directed to propagate towards a user's ear. In some embodiments, the audio emitters included in an audio emitter configuration 251 generate multiple soundwaves that combine at a target point. The composite soundwave that is produced when the multiple soundwaves combine propagates in a direction orthogonal to the propagation directions of the multiple soundwaves generated by audio emitters in audio emitter configuration 251. In some embodiments, each audio emitter in an audio emitter configuration 251 may receive a separate and distinct audio emitter driver signal. In such instances, each audio emitter in the audio emitter configuration 251 may receive a separate and distinct audio emitter driver signal based on the overall configuration of the audio emitter configuration 251 and/or the overall configuration of multiple audio emitter configurations 251 included in the audio emitter device 205.

In some embodiments, audio emitter configuration 251 may include two or more symmetrical arrangements of discrete audio emitters such that audio emitter configuration 251 includes at least one line of symmetry. For example, audio emitter configuration 251 may include at least three audio emitters symmetrically arranged in an equilateral triangle, having at least three lines of symmetry. In some embodiments, an audio emitter configuration 251 may be a single, curved electromechanical surface that emits multiple soundwaves in a symmetrical configuration in response to an audio emitter driver signal. For example, audio emitter configuration 251 may comprise a single surface made of carbon nanotube material, or ferroelectret nanogenerator (FENG) material.

Audio measurement module 253 may be hardware and/or software that measures one or more physical components associated with audio emitter device 205 producing soundwaves that reproduce the audio emitter driver signal. In some embodiments, audio measurement module 253 may be a component included in audio emitter device 205, such as a thermometer or microphone, which measures and/or records a physical component in audio emitter device 205. For example, audio measurement module 253 may be one or more microphones suspended within an audio emitter configuration 251 and/or audio emitter device 205 that records measured audio signals within the audio emitter device 205. The measured audio signals may include a target audio signal corresponding to the audio signal generated by audio source 201, outside audio signals generated by other audio sources in an environment (e.g., the user's speech, other speakers, and/or other audio source devices), and/or audio noise signals.

Figure 3A:
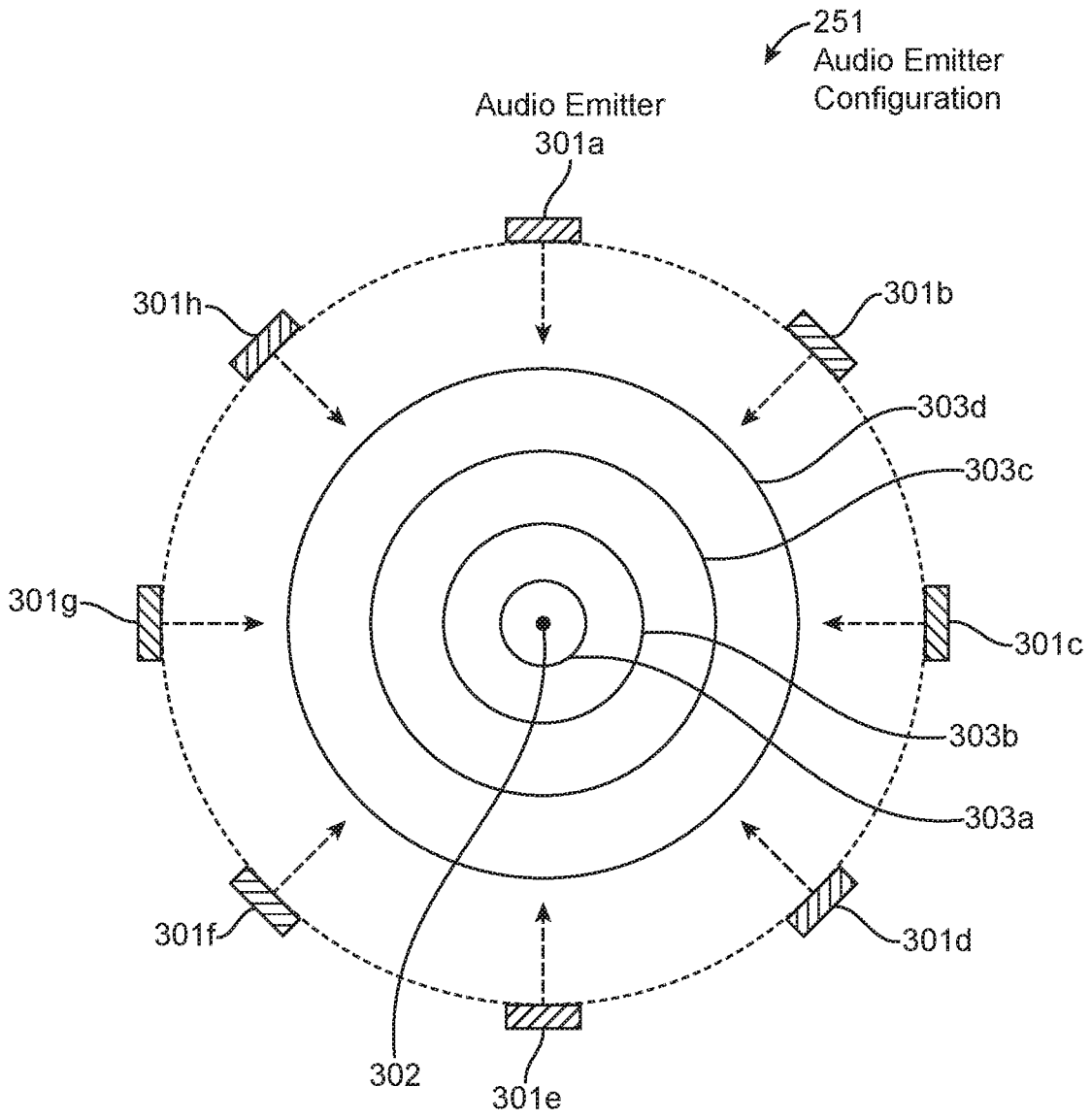
FIG. 3A illustrates a single audio emitter configuration included in the audio delivery system of FIG. 2, according to various embodiments of the present disclosure.

FIG. 3 illustrates a single audio emitter configuration 251 included in the audio delivery system 200 of FIG. 2, according to various embodiments of the present disclosure. Audio emitter configuration 251 includes a set of audio emitters, 301*a-h* arranged symmetrically around a target point 302. In operation, each of audio emitters 301*a-h* emits a soundwave in the direction of target point 302. The soundwaves produced by each of audio emitters 301*a-h* meet at target point 302 and combine to produce a composite soundwave ("target soundwave"), represented by longitudinal waves 303*a-d*.

In some embodiments, audio emitters 301*a-h* are in a specific physical arrangement, where an audio transducer included in each audio emitter 301*a-h* emits a separate and distinct soundwave that reproduces an input audio emitter driver signal. In some embodiments, audio emitter configuration 251 may include a single surface that generates the multiple soundwaves at different positions. Each audio emitter 251*a-h* includes an audio transducer, (e.g., a sound actuator). The audio transducer receives an electrical input signal and emits a separate and distinct soundwave having wave characteristics corresponding to the electrical input signal. For example, each of audio emitters 301*a-h* may receive an audio emitter driver signal from controller 203 and may emit a separate soundwave propagating towards target point 302. In some embodiments, the soundwave generated by each audio emitter 301*a-h* may differ from other soundwaves generated from other audio emitters 301*a-h*. For example, a first audio emitter 301*a* may emit a first soundwave that propagates from audio emitter 301*a* at a specific angle and with a specific amplitude such that a portion of the first soundwave reaches target point 302. A second audio emitter 301*b* may also emit a second soundwave that propagates from audio emitter 301*b* at a different angle and/or with a different amplitude than the first soundwave. In some embodiments, each audio emitter 301*a-h* may receive separate audio emitter driver signals, where the separate audio emitter driver signals depend on the configuration of the audio emitters 301*a-h* in order for the audio emitters 301*a-h* to produce a set of soundwaves that generates the target soundwave 303*a-d*.

Target point 302 is a position in relation to the one or more audio emitters 301*a-h* where the set of soundwaves emitted from audio emitters 301*a-h* combine to produce the target soundwave 303*a-d*. The soundwaves emitted from each of audio emitters 301*a-h* may combine at one or more locations produce one or more composite soundwaves, including the target soundwave 303*a-d*. For example, portions of soundwaves emitted from each of audio emitters 301*a-h* combine at target point 302 to generate a composite soundwave that propagates from target point 302 in two directions.

In some embodiments, the composite soundwave produced at target point 302 has portions that propagate bidirectionally, including a target soundwave component ("target soundwave") that propagates in a direction towards the user's ear. The composite soundwave may also include a parasitic soundwave component ("parasitic soundwave") that propagates in a direction away from the ear. In some embodiments, controller 203 may modify the one or more audio emitter driver signals transmitted to audio emitter configuration 251 to attenuate the amplitude of the parasitic soundwave. In some embodiments, controller may modify the one or more audio emitter driver signals such that a portion the composite soundwave destructively interferes with the parasitic soundwave to attenuate the amplitude of the parasitic soundwave. In some embodiments, the composite soundwave has an amplitude that is significantly larger (e.g., 5 to 15 times larger) than the amplitude of the parasitic soundwave. In some embodiments, controller 203 may modify the one or more audio emitter driver signals such that the parasitic soundwave produced by audio emitter configuration 251 has characteristics that include the anti-noise signal. In such instances, the parasitic soundwave may combine with the measured noise signal to create destructive interference with the measured noise signal, attenuating the amplitude of the measured noise signal.

Target soundwave 303*a-d* produced at target point 302 emanates from target point 302 and propagates within audio emitter device 205 in a direction towards the user's ear. In some embodiments, target soundwave 303*a-d* propagates in a direction orthogonal to the plane of audio emitter configuration 251. For example, when audio emitter configuration 251 has one or more audio emitters 301*a-h* aligned along a single plane, target soundwave 303*a-d* propagates in longitudinal waves 303*a-d* starting from target point 302. In some embodiments, target soundwave 303*a-d* is produced from an increase in pressure at the target point 302 when portions of multiple soundwaves emitted from audio emitters 301*a-h* reach target point 302 simultaneously. In some embodiments, target soundwave 303*a-d* comprises a near planar wave. This occurs, for example, when target soundwave 303*a-d* has a wavelength that is longer than the diameter of audio emitter configuration 251.

Figure 3B:
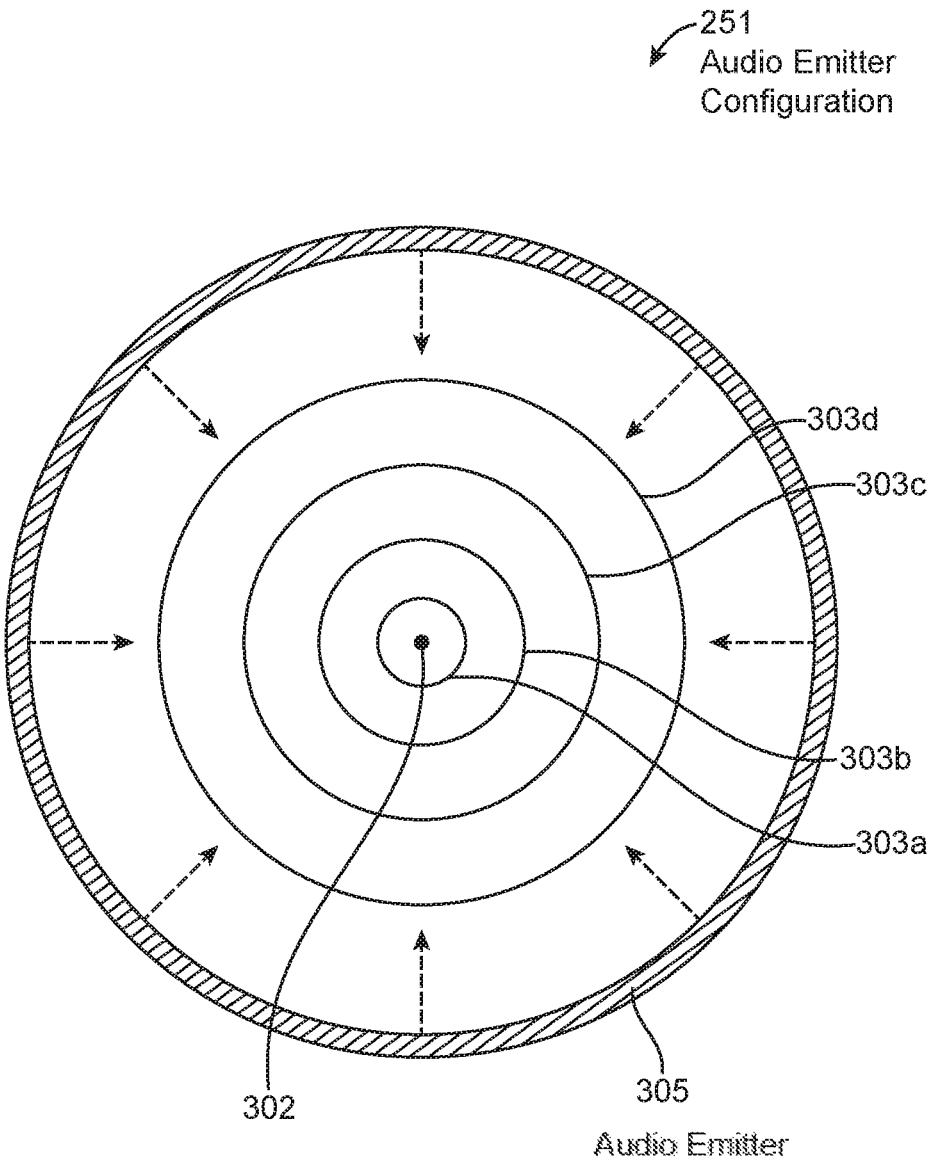
FIG. 3B illustrates another single audio emitter configuration included in the audio delivery system of FIG. 2, according to various embodiments of the present disclosure.

FIG. 3B illustrates another single audio emitter configuration 251 included in the audio delivery system 200, according to various embodiments of the present disclosure. In some embodiments, audio emitter configuration 251 includes single, curved electromechanical surface 305 that emits multiple soundwaves in response to an audio emitter driver signal. Surface 305 may comprise a single surface made of carbon nanotube material, or ferroelectret nanogenerator (FENG) material. Surface 305 may generate multiple soundwaves that combine at target point to produce composite soundwaves, including target soundwave 303*a-d*.

Figure 4A:
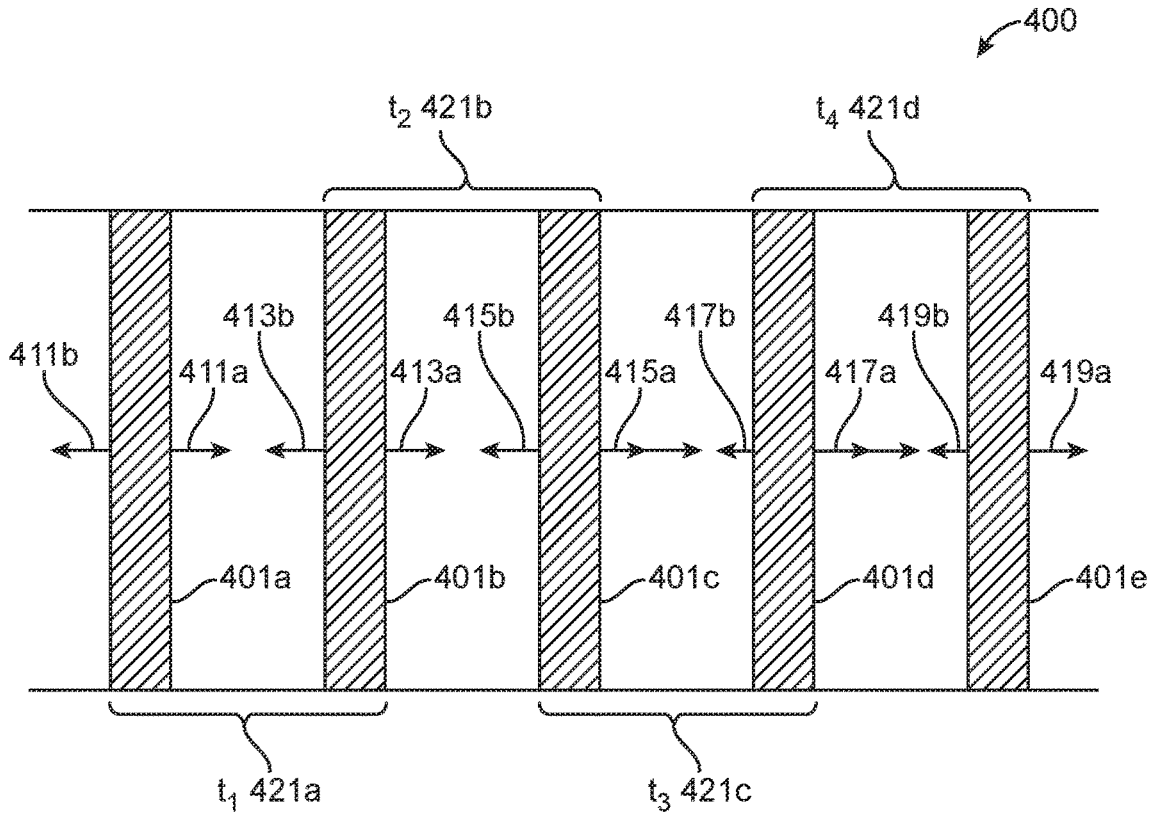
FIG. 4A illustrates an audio emitter device included in the audio delivery system of FIG. 2, according to various embodiments of the present disclosure.

FIG. 4A illustrates an audio emitter device 400 included in the audio delivery system 200 of FIG. 2, according to various embodiments of the present disclosure. Audio emitter device 400 may comprise an array that includes multiple audio emitter configurations 401*a-e* that align along a common axis. During operation, audio emitter configurations 401*a-e* produce composite soundwaves 411*a*-419*a*, 411*b*-419*b* orthogonal to the plane of the audio emitter configurations 401*a-e*. In some embodiments, controller 203 may configure one or more audio emitter driver signals to cause a plurality of composite soundwaves propagating in a first direction 411*a*-419*a* to combine constructively within audio emitter device 400, while causing a plurality of composite soundwaves propagating in the opposite direction, 411*b*-419*b* to be attenuated.

In some embodiments, controller 203 may transmit multiple audio emitter driver signals that cause audio emitter configurations 401*a-e* included in audio emitter device 400 to produce composite soundwaves 411*a*-419*a* and 411*b*-419*b* with a relative delay. In some embodiments, audio driver 231 may generate an audio driver signal that delays one or more of audio emitter configurations 401*b-e* from emitting soundwaves that reproduce the audio signal transmitted by audio source 201 for a specified period. For example, controller 203 may generate an audio emitter driver signal for audio emitter configuration 401*b* that incorporates a time delay t1 421*a* that is based on the time that soundwave 411*a* travels from audio emitter configuration 401*a* to audio emitter configuration 401*b*.

In some embodiments, controller 203 may determine the physical distance between neighboring audio emitter configurations 401*a-b* and may calculate the time delay to incorporate into the corresponding audio emitter driver signal based on the determined physical distance and calculated speed that a composite soundwave travels within the audio emitter device 400. For example, when audio emitter configuration 401*b* is spaced at a 1 mm distance away from audio emitter configuration 401*a*, controller 203 and/or audio calibration module 233 may include a calibration signal that imposes a 3 μs delay $t_1$ 421*a* to the audio emitter driver signal that is transmitted to audio emitter configuration 401*b*. During operation, audio emitter configuration 401*b* receives the audio emitter driver signal with the incorporated time delay, causing audio emitter configuration 401*b* to produce composite soundwave 413*a* 3 μs after audio emitter configuration 401*a* produces composite soundwave 411*a*. Composite soundwave 411*a* propagates within audio emitter device 400 in manner where composite soundwave 413*a* is produced simultaneously with composite soundwave 411*a* reaching audio emitter configuration 401*b*.

In some embodiments, controller 203 may coordinate audio emitter driver signals to incorporate each of time delays $t_1$-$t_4$ 421*a-d* to in order to coordinate the propagation of composite soundwaves 411*a*-419*a*. When controller 203 coordinates composite soundwaves 411*a*-419*a*, audio emitter device 400 may produce a pressure difference gradient across the audio emitter configurations 401*a-e*. In such embodiments, audio emitter device 400 produces the target soundwave that is based in part on combining each of the composite soundwaves propagating in a first direction 411*a*-419*a*. In some embodiments, controller 203 coordinates each of time delays $t_1$-$t_4$ 421*a-d* to in order to attenuate each of the composite soundwaves propagating in the opposite direction 411*b*-419*b*.

Figure 4B:
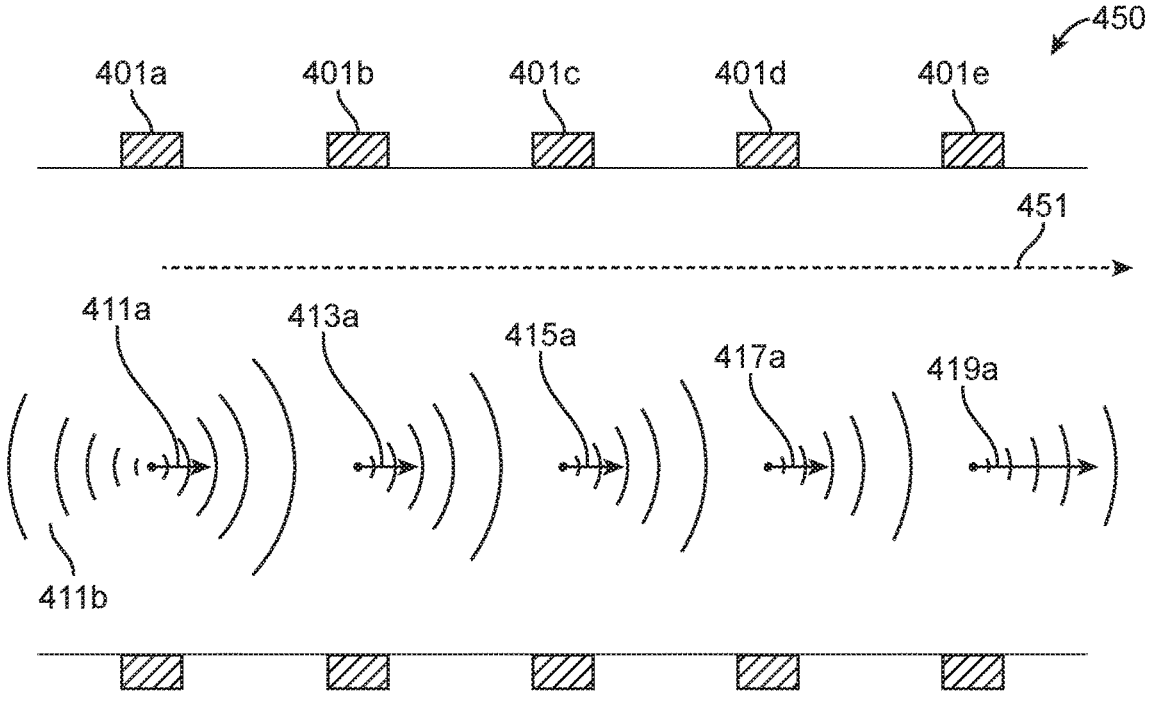
FIG. 4B illustrates another audio emitter device included in the audio delivery system of FIG. 2, according to various embodiments of the present disclosure.

FIG. 4B illustrates another audio emitter device 450 included in the audio delivery system of FIG. 2, according to various embodiments of the present disclosure. Audio emitter device 450 is similar to audio emitter device 400 and includes the set of audio emitter configurations 401*a-e*. During operation, controller 203 coordinates each of audio emitter configurations 401*a-e* such that the composite soundwaves 411*a*-419*a* produced by the audio emitter configurations 401*a-e* combine to produce target soundwave 451. In some embodiments, one or more of composite soundwaves 411*a*, 413*a*, 415*a*, 417*a*, 419*a* combine constructively to produce target soundwave 451 within audio emitter device 450, where target soundwave 451 propagates in a specified direction. In some embodiments, the amplitude of target soundwave 451 is equal to the sum of the two or more of composite soundwaves 411-419*a*.

In some embodiments, controller 203 may modify one or more audio emitter driver signals transmitted to individual audio emitter configurations 401*a-e* and/or individual audio emitters 301*a-h* included in audio emitter configurations 401*a-e* in order to adjust the target soundwave 451 produced by audio emitter device 450. In some embodiments, controller 203 may modify the one or more audio emitter driver signals to maintain the propagation angle of target soundwave 451. In such instances, audio emitter device 450 adjusts the soundwaves emitted from one or more audio emitters 3001*a-h* in order to produce a composite soundwave 411*a*-419*a* that remains orthogonal to the plane of the audio emitter configurations 401*a-e*. In some embodiments, controller 203 may modify the one or more audio emitter driver signals in order to adjust the amplitude of target soundwave 451.

Figure 5:
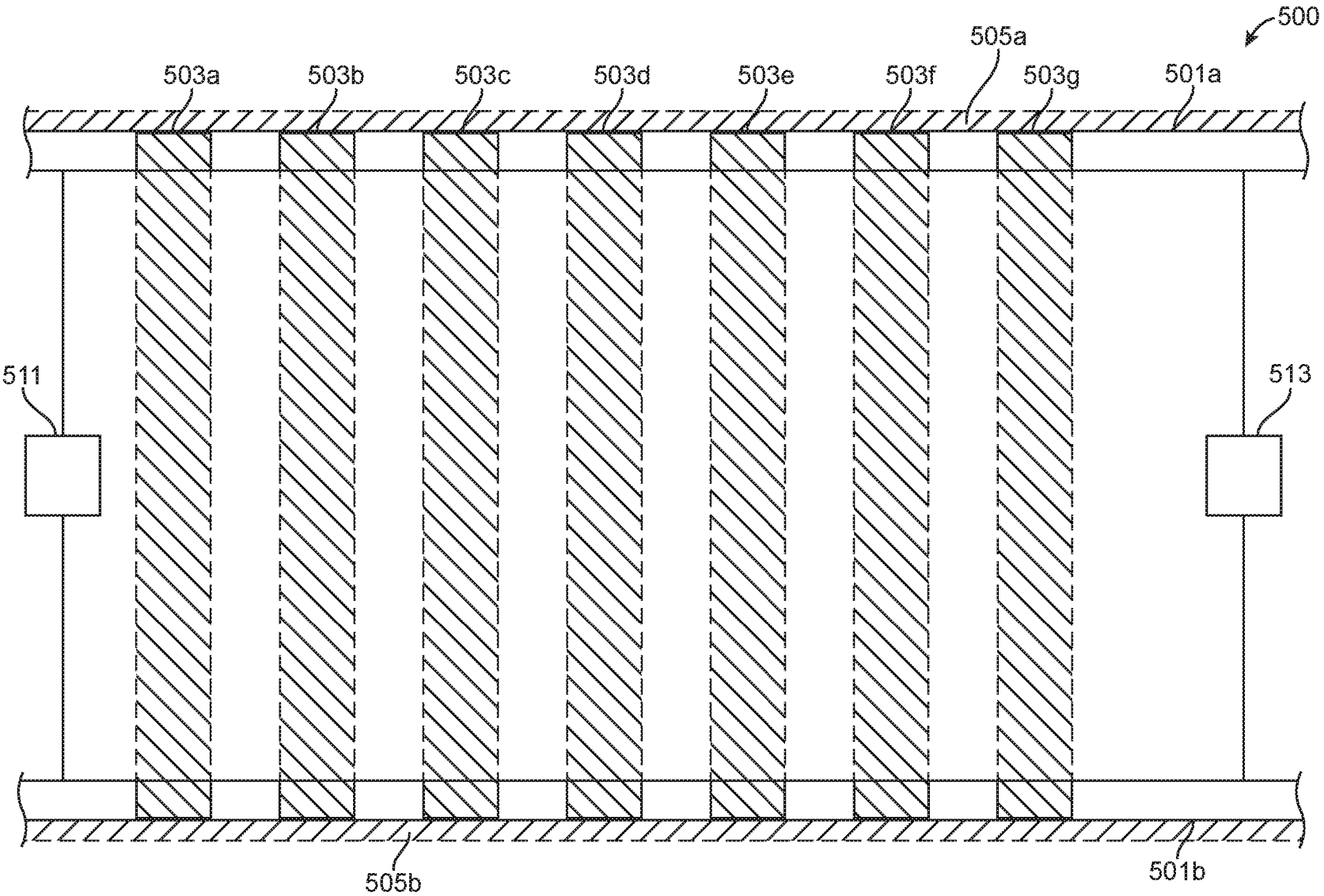
FIG. 5 illustrates another audio emitter device included in the audio delivery system of FIG. 2, according to various embodiments of the present disclosure.

FIG. 5 illustrates another audio emitter device 500 included in the audio delivery system 200 of FIG. 2, according to various embodiments of the present disclosure. In some embodiments, audio emitter device 500 is similar to audio emitter device 400 and 450 and includes alignment walls 501*a-b*, a plurality of audio emitter configurations 503*a-g*, pliable layers 505*a-b*, and measurement devices 511 and 513.

Alignment walls 501*a-b* may comprise a physical matter that aligns one or more audio emitter configurations 503*a-g* along a common plane. In some embodiments, alignment walls 501*a-b* may align target points 302 for each audio emitter configuration 503*a-g* along a common axis. In some embodiments, alignment walls 501*a-b* may be made from the same material as audio emitter configurations 503*a-g*, such as carbon nanotube material, or ferroelectret nanogenerator (FENG) material. In some embodiments, audio emitter configuration array 500 may align multiple audio emitter configurations along alignment walls 501*a-b* without physical materials.

Pliable layers 505*a-b* are layers of flexible material that are configured between alignment walls 501*a-b* and the user's ear. In some embodiments, pliable layers 505*a-b* physically contact the interior walls of the ear canal while audio delivery system 200 is in operation. In some embodiments, pliable layers 505*a-b* are flexible and have a thickness that distorts within the user's ear without changing the physical characteristics, such as the dimensions, of alignment walls 501*a-b* and/or audio emitter configurations 503*a-g*. The distortion by pliable layers 505*a-b* may allow audio emitter device 500 to extend into the ear canal and fit snugly within the ear of the user.

Measurement devices 511 and 513 may be one or more physical devices included in audio emitter device 500 that measure physical quantities associated with audio emitter device 500 producing the target soundwave 451. In some embodiments, measurement devices 511 and 513 may comprise one or more microphones and/or thermometers suspended within audio emitter device 500. In some embodiments, measurement devices 511 and 513 may be located within alignment walls 501*a-b* and/or attached to one or more of alignment walls 501*a-b*. In some embodiments, measurement devices 511 and 513 may include software to perform measurements and/or record the results of the measurements and/or associated calculations. During operation, measurement devices 511 and 513 may capture measurement data and send one or more measurement values to the controller 203. In some embodiments, measurement device 511 may record a sound at a first time and measurement device 513 may measure a sound at a second time. Controller may compute the speed of sound within audio emitter device. Controller 203 may calibrate time delays between audio emitter configurations 503*a-g* based on the calculated speed of sound within audio emitter device 500.

Controller 203 may use one or more of audio calibration module 233, noise cancellation module 237, and/or filter 239 to adjust one or more audio emitter driver signals to compensate for the measured values. For example, measurement devices 511 and 513 may be one or more microphones suspended within audio emitter device 500 that records audio signals corresponding to soundwaves propagating within audio emitter configuration array 500. In some embodiments, measurement devices 511 and 513 may be one or more thermometers that records temperature measurements. For example, measurement devices may record the temperature and/or humidity within audio emitter device 500. In some embodiments, audio calibration module 233 may use one or more of the recorded temperature measurements to calculate the speed of sound traveling within audio emitter device 500. Measurement devices 511 and 513 may record measurement data and send measurement values to controller 203.

Figure 6:
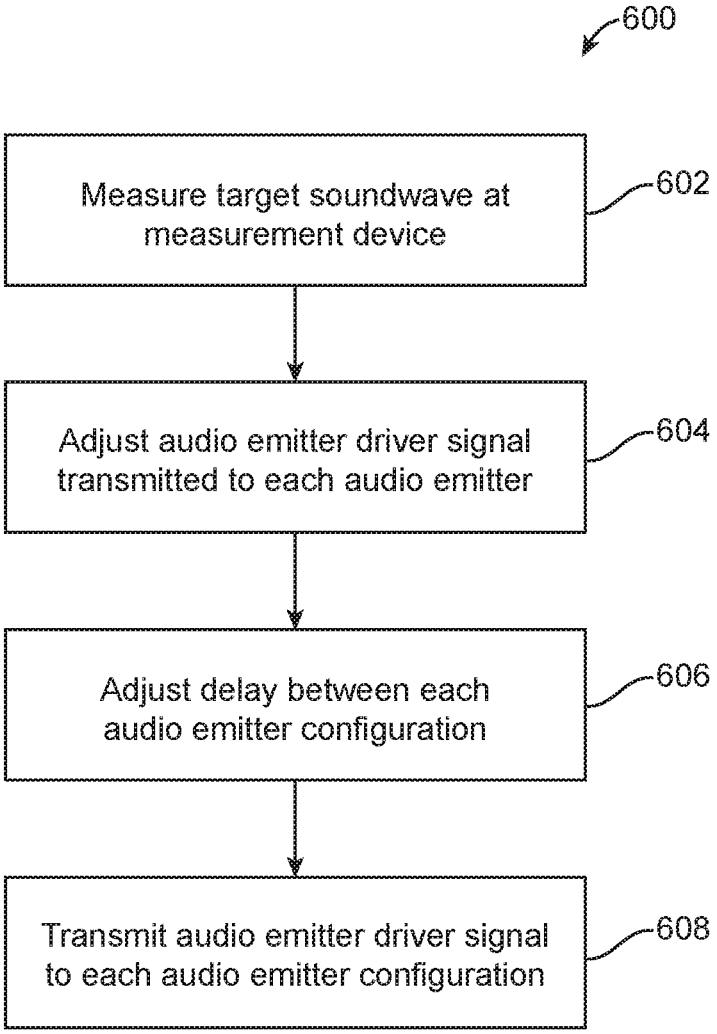
FIG. 6 sets forth a flow diagram of method steps for calibrating and producing a soundwave using an audio emitter device, according to various embodiments of the present disclosure.

FIG. 6 sets forth a flow diagram of method steps for calibrating and producing a soundwave using an audio emitter device, according to various embodiments of the present disclosure. Although the method steps are described with reference to the systems of FIGS. 1-5, persons skilled in the art will understand that the method steps can be performed in any order by any system.

Method 600 begins at step 602, where audio delivery system 200 measures a target soundwave at an audio measurement device 253. In some embodiments, audio delivery system 200 may calibrate one or more audio emitters 301*a-h* in an audio emitter configuration 251 by acquiring measurement data via one or more audio measurement devices 253. In some embodiments, audio measurement devices 253 may acquire measurement data related to one or more audio emitters 301*a-h* from emitter configurations 503*a-g* emitting multiple soundwaves that produce the target soundwave 451. In some embodiments, audio measurement devices 253 may acquire measurement data based on the target soundwave 451.

At step 604, audio delivery system 200 adjusts one or more audio emitter driver signals transmitted to one or more audio emitters 301*a-h*. In some embodiments, one or more of audio calibration module 233, noise cancellation module 237, and/or filter 239 may receive measurement values, generated from measurement data, from audio measurement devices 253. In some embodiments, audio calibration module 233, noise cancellation module 237, and/or filter 239 may generate one or more signals that controller 203 may incorporate into the characteristics of one or more generated audio emitter driver signals. In some embodiments, the signals may include a calibration signal that incorporates time delay, a noise cancellation signal, and/or an inverse filter signal. In some embodiments, controller 203 implements audio driver 231 to modify one or more audio emitter driver signals transmitted to audio emitter device 205 in order to adjust the target soundwave 451 that propagates in the direction of the user's ear.

At step 606, audio delivery system 200 adjusts time delays between each respective audio emitter configuration 401*a-e*. In some embodiments, one or more of audio calibration module 233, noise cancellation module 237, and/or filter 239 may generate signals that controller 203 incorporates into the characteristics of one or more audio emitter driver signals. The plurality of audio emitter driver signals adjust one or more time delays 421*a-d* between respective audio emitter configurations 401*a-e* emitting soundwaves to produce the composite soundwaves 411-419*a* that combine to produce the target soundwave 451. In some embodiments, the signals from audio calibration module 233, noise cancellation module 237, and/or filter 239 cause a second audio emitter configuration 401*b* to delay the production of a second composite signal 413*a* until a first composite signal 411*a* that was produced by a first audio emitter configuration 401*a* reaches the second audio emitter configuration 401*b*. The two composite signals 411*a*, 413*a* may combine at the location of the second audio emitter configuration 401*b* to generate target soundwave 451 such that target soundwave 451 propagates within audio emitter configuration array 450 in the specified direction (i.e., towards the user's ear).

At step 608, audio delivery system 200 transmits the one or more audio emitter driver signals to audio emitter device 400. In some embodiments, controller 203 may implement audio driver 231 to generate one or more audio emitter driver signals; audio driver 231 generates the one or more audio emitter driver signals based on the audio signal transmitted by audio source 201. In some embodiments, audio driver 231 may generate separate and distinct audio emitter driver signals for each audio emitter 301*a-h* included in an audio emitter device 205. In some embodiments, audio driver 231 transmits one or more audio emitter driver signals that incorporate characteristics that adjustment the target soundwave 451. In some embodiments, audio driver 231 may delay the transmission of one or more audio emitter driver signals to one or more of the audio emitter configurations 401*a-e* based on the delay determined in step 606. In alternative embodiments, audio driver 231 may transmit each audio emitter driver signal simultaneously, with one or more of the transmitted audio emitter driver signal incorporating a time delay as determined in step 606.

In some embodiments, each audio emitter 301*a-h* in an audio emitter configuration 251 emits a soundwave towards a target point 302 relative to the audio emitter configuration 251. In some embodiments, each audio emitter 301*a-h* receives an audio emitter driver signal and causes an audio transducer included in the audio emitter 301*a-h* to emit a soundwave that reproduces the audio emitter driver signal.

In some embodiments, the soundwaves emitted from each audio emitter 3011*a-h* in an audio emitter device 205 combine at the target point 302 to generate a composite soundwave. In some embodiments, audio emitters 301*a-h* in multiple audio emitter configurations 401*a-e* of an audio emitter device 400 may emit soundwaves such that multiple composite soundwaves 411-419*a*, 411-419*b* emanate from each audio emitter configuration 401*a-e*. In some embodiments, composite soundwaves 411-419*a* may combine to generate target soundwave 451 that propagates within audio emitter device 451 in a specified direction. In some embodiments, the audio emitter configurations 401*a-e* produce each composite soundwaves 411-419*a* while incorporating a time delay such that the target soundwave 451 is produced by coordinating the combination of composite soundwaves 411-419*a* propagating in the same direction. In some embodiments, one or more audio measurement devices 511, 513 included in an audio emitter device 500 may measure the target soundwave 451 and/or other physical components and send the measurement values to controller 203, where controller 203 continually makes adjustments by modifying one or more audio emitter driver signals.

In sum, embodiments of the present disclosure are directed towards an audio emitter configuration that produces multiple soundwaves along a plane. The multiple soundwaves combine at a target point, increasing pressure at the target point to produce a composite soundwave that emanates from the target point and propagates in directions orthogonal to the plane of the audio emitter configuration. In some embodiments, multiple audio emitter configurations can be physically configured and operationally controlled to generate a target soundwave by combining multiple composite soundwaves that are propagating orthogonal to individual audio emitter configurations. In some embodiments, a controller may implement one or more modules to adjust audio emitter driver signals transmitted to the audio emitter configurations to ensure that the target soundwave is propagating in a specified direction at a specified amplitude. In some embodiments, the controller generates audio emitter driver signals that incorporate time delays associated with the target soundwave propagating within the audio emitter device.

At least one advantage of the disclosed embodiments is that the audio emitter configuration provides a technological improvement of effectively directing a created sound into the ear canal of the user without occluding other sounds. Arranging one or more configurations of audio emitters orthogonal to the direction of the user's ears enables other sounds to travel within the audio emitter configuration array unimpeded, enabling the user to clearly hear sounds other than the sounds generated by an audio source.

1. In some embodiments, a wearable device comprises an interface layer configured to extend into an ear canal and a first audio emitter configuration coupled to the interface layer and configured to produce a first plurality of soundwaves that are each directed towards a first point proximate to the first audio emitter configuration, where the first plurality of soundwaves generating a first target soundwave that radiates in a first direction.

2. The wearable device of clause 1, wherein the first point comprises a center of the first audio emitter configuration and the first target soundwave comprises a wavelength that is larger than a diameter of the first audio emitter configuration.

3. The wearable device of clause 1 or 2, wherein the first direction and a plane of the first audio emitter configuration are orthogonal.

4. The wearable device of any of clauses 1-3, wherein the wearable device further comprises a second audio emitter configuration that produces a second plurality of soundwaves that are each directed towards a second point proximate to the second audio emitter configuration, the second plurality of soundwaves generating a second target soundwave that radiates in the first direction.

5. The wearable device of any of clauses 1-4, wherein the first target soundwave combines with the second target soundwave to generate a first cumulative soundwave in the first direction.

6. The wearable device of any of clauses 1-5, wherein the first audio emitter configuration generates a parasitic soundwave radiating opposite the first direction.

7. The wearable device of any of clauses 1-6, wherein the first cumulative soundwave has a first amplitude and the parasitic soundwave has a second amplitude, wherein the first amplitude is larger than the second amplitude 8. The wearable device of any of clauses 1-7, wherein the second audio emitter configuration produces the second plurality of soundwaves following a first delay after the first audio emitter configuration produces the first plurality of soundwaves.

9. The wearable device of any of clauses 1-8, wherein the wearable device further comprises a first calibration device configured to determine a first measurement based on the first target soundwave propagating from the first audio emitter configuration; and generate a first calibration signal that adjusts the first delay based on the first measurement.

10. The wearable device of any of clauses 1-9, wherein the first calibration device comprises at least one microphone.

11. The wearable device of any of clauses 1-10, wherein the first calibration device comprises a thermometer.

12. The wearable device of any of clauses 1-11, wherein the wearable device further comprises a first microphone that records a first measurement associated with noise.

13. The wearable device of any of clauses 1-12, wherein the first audio emitter configuration comprises a set of audio transducers, wherein each of the set of audio transducers generates one of the first plurality of soundwaves.

14. The wearable device of any of clauses 1-13, wherein the first audio emitter configuration comprises a single electromagnetic surface comprising at least one of a carbon nanotube material, or a ferroelectret nanogenerator (FENG) material.

15. In some embodiments, a system comprises a controller configured to transmit an audio emitter driver signal generated based on a source audio signal, and an audio emitter device coupled to the controller, where the audio emitter device comprises an interface layer configured to extend into an ear canal, and a first audio emitter configuration coupled to the interface layer and configured to, in response to the audio emitter driver signal, produce a first plurality of soundwaves that are each directed towards a first point proximate to the first audio emitter configuration.

16. The wearable device of clause 15, wherein the controller further comprises an inverse filter that generates a first noise cancellation signal.

17. The wearable device of clause 15 or 16, wherein the inverse filter is configured to receive a first measurement from a calibration device; and generate the first noise cancellation signal based on the first measurement.

18. In some embodiments a method comprises receiving an audio emitter driver signal associated with an audio signal, and in response to receiving the audio emitter driver signal, generating a first target soundwave that radiates in a first direction by directing a first plurality of soundwaves towards a first point.

19. The method of clause 18, which further comprises receiving a second audio emitter driver signal associated with the audio signal following a first delay after receiving the audio emitter driver signal, and in response to the second audio emitter driver signal, generating a second target soundwave that radiates in the first direction based on directing a first plurality of soundwaves towards a second point.

20. The method of clause 18 or 19, wherein the first target soundwave combines with the second target soundwave to generate a first cumulative soundwave in a first direction.

Any and all combinations of any of the claim elements recited in any of the claims and/or any elements described in this application, in any fashion, fall within the contemplated scope of the present disclosure and protection.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a ""module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine. The instructions, when executed via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable gate arrays.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

What is claimed is:

1. A wearable device, comprising:

an interface layer configured to extend into an ear canal; and a first audio emitter configuration coupled to the interface layer and configured to reside within the ear canal, the first audio emitter configuration comprising a plurality of audio emitters configured to produce a first plurality of soundwaves that are each directed to a first point proximate to the first audio emitter configuration, the plurality of audio emitters arranged around and facing the first point, the first plurality of soundwaves generating a first target soundwave that radiates in a first direction.

2. The wearable device of claim 1, wherein the first point comprises a center of the first audio emitter configuration and the first target soundwave comprises a wavelength that is larger than a diameter of the first audio emitter configuration.

3. The wearable device of claim 1, wherein the first direction and a plane of the first audio emitter configuration are orthogonal.

4. The wearable device of claim 1, wherein the wearable device further comprises a second audio emitter configuration that produces a second plurality of soundwaves that are each directed towards a second point proximate to the second audio emitter configuration, the second plurality of soundwaves generating a second target soundwave that radiates in the first direction.

5. The wearable device of claim 4, wherein the first target soundwave combines with the second target soundwave to generate a first cumulative soundwave in the first direction.

6. The wearable device of claim 5, wherein the first audio emitter configuration generates a parasitic soundwave radiating opposite the first direction.

7. The wearable device of claim 6, wherein the first cumulative soundwave has a first amplitude and the parasitic soundwave has a second amplitude, wherein the first amplitude is larger than the second amplitude.

8. The wearable device of claim 4, wherein the second audio emitter configuration produces the second plurality of soundwaves following a first delay after the first audio emitter configuration produces the first plurality of soundwaves.

9. The wearable device of claim 8, wherein the wearable device further comprises a first calibration device configured to:

determine a first measurement based on the first target soundwave propagating from the first audio emitter configuration; and generate a first calibration signal that adjusts the first delay based on the first measurement.

10. The wearable device of claim 9, wherein the first calibration device comprises at least one microphone.

11. The wearable device of claim 9, wherein the first calibration device comprises a thermometer.

12. The wearable device of claim 1, wherein the wearable device further comprises a first microphone that records a first measurement associated with noise.

13. The wearable device of claim 1, wherein the first audio emitter configuration comprises a set of audio transducers, wherein each of the set of audio transducers generates one of the first plurality of soundwaves.

14. The wearable device of claim 1, wherein the first audio emitter configuration comprises a single electromagnetic surface comprising at least one of:

a carbon nanotube material, or a ferroelectret nanogenerator (FENG) material.

15. A system, comprising:

a controller configured to transmit an audio emitter driver signal generated based on a source audio signal; and an audio emitter device coupled to the controller, the audio emitter device comprising:

an interface layer configured to extend into an ear canal, and a first audio emitter configuration coupled to the interface layer and configured to reside within the ear canal, the first audio emitter configuration comprising a plurality of audio emitters configured to produce a first plurality of soundwaves that are each directed towards a first point proximate to the first audio emitter configuration, the plurality of audio emitters arranged around and facing the first point.

16. The wearable device of claim 15, wherein the controller further comprises an inverse filter that generates a first noise cancellation signal.

17. The wearable device of claim 15, wherein the inverse filter is configured to:

receive a first measurement from a calibration device; and generate the first noise cancellation signal based on the first measurement.

18. A method comprising:

receiving an audio emitter driver signal associated with an audio signal; and in response to receiving the audio emitter driver signal, driving each of a plurality of audio emitters, of a first audio emitter configuration configured to reside within an ear canal, to produce a first plurality of soundwaves that are each directed towards a first point proximate to the first audio emitter configuration, the plurality of audio emitters arranged around and facing the first point, the first plurality of soundwaves generating a first target soundwave that radiates in a first direction.

19. The method of claim 18, further comprising:

receiving a second audio emitter driver signal associated with the audio signal following a first delay after receiving the audio emitter driver signal; and in response to the second audio emitter driver signal, generating a second target soundwave that radiates in the first direction based on directing a second plurality of soundwaves towards a second point.

20. The method of claim 19, wherein the first target soundwave combines with the second target soundwave to generate a first cumulative soundwave in the first direction.

* * * * *